US006012296A

United States Patent [19]

Shah

[11] Patent Number: 6,012,296

[45] Date of Patent: Jan. 11, 2000

[54] AUCTIONEERING TEMPERATURE AND HUMIDITY CONTROLLER WITH REHEAT

[75] Inventor: Dipak J. Shah, Eden Prairie, Minn.

[73] Assignee: Honeywell Inc., Minneapolis, Minn.

[21] Appl. No.: 08/919,884

[22] Filed: Aug. 28, 1997

[51] Int. Cl.[7] ..... F25B 29/00; F24F 3/14

[52] U.S. Cl. ..... 62/173; 62/176.6; 165/228

[58] Field of Search ..... 62/173, 176.5, 62/176.6; 236/44 C; 165/228

[56] References Cited

U.S. PATENT DOCUMENTS

| | | | |
|---|---|---|---|
| 3,012,411 | 12/1961 | Kdellman | 62/173 |
| 3,651,864 | 3/1972 | Maddox, Jr. | 161/60 |
| 4,105,063 | 8/1978 | Bergt | 236/44 C X |
| 4,300,623 | 11/1981 | Meckler | 165/50 X |
| 4,312,189 | 1/1982 | Cotton, Jr. | 62/179 X |
| 4,494,596 | 1/1985 | Bradshaw | 261/129 X |
| 4,841,733 | 6/1989 | Dussault et al. | 62/93 |
| 4,873,649 | 10/1989 | Grald et al. | 62/176.6 |
| 4,889,280 | 12/1989 | Grald et al. | 236/44 C |
| 4,974,665 | 12/1990 | Zillner, Jr. | 236/51 X |
| 5,014,519 | 5/1991 | Noji et al. | 62/173 X |
| 5,024,265 | 6/1991 | Buchholz et al. | 236/49.3 X |
| 5,062,276 | 11/1991 | Dudley | 62/176.6 |
| 5,129,234 | 7/1992 | Alford | 62/176.6 |
| 5,279,609 | 1/1994 | Meckler | 236/49.3 |
| 5,314,004 | 5/1994 | Strand et al. | 165/2 |
| 5,329,782 | 7/1994 | Hyde | 62/90 |
| 5,345,776 | 9/1994 | Komazaki et al. | 62/176.3 |
| 5,346,127 | 9/1994 | Creighton | 236/13 |
| 5,346,129 | 9/1994 | Shah et al. | 236/44 C |
| 5,408,838 | 4/1995 | Yaeger et al. | 62/92 |
| 5,461,877 | 10/1995 | Shaw et al. | 62/185 |
| 5,467,287 | 11/1995 | Wenner et al. | 62/176.6 Y |
| 5,675,979 | 10/1997 | Shah | 62/176.6 |
| 5,737,934 | 4/1998 | Shah | 62/176.6 |

FOREIGN PATENT DOCUMENTS

| | | | |
|---|---|---|---|
| 518327 | 6/1992 | European Pat. Off. . | |
| 0588052A1 | 3/1994 | European Pat. Off. . | |
| 146347 | 11/1980 | Japan | 62/176.6 |
| 117041 | 6/1985 | Japan . | |

OTHER PUBLICATIONS

R.G. Steadman, "The Assessment of Sultriness, Part I: A Temperature–Humidity Index Based on Human Physiology and Clothing Science". Manuscript received Jan. 3, 1978, in final form Apr. 11, 1979.

1993 ASHRAE Handbook of Fundamentals, "Physiological Principles and Thermal Comfort".

Robert Quayle & Fred Doehring "Heat Stress" A Comparison of Indices.

ASHRAE Standard ANSI/ASHRAE 55–1992 "Thermal environmental Conditions for Human Occupancy".

*Primary Examiner*—William Wayner
*Attorney, Agent, or Firm*—Ian D. Mackinnon

[57] ABSTRACT

A controller for climate controller system having a humidity and temperature sensor wherein the controller operates to insure that both temperature and humidity are within comfort levels. Wherein said controller further controls a reheat system which reheats chilled air in order to keep the dry bulb temperature of an enclosure near a specific set point.

46 Claims, 3 Drawing Sheets

AUCTIONEERING TEMPERATURE AND HUMIDITY CONTROLLER WITH REHEAT

BACKGROUND OF THE INVENTION

This invention is directed generally to control of indoor climate modifying apparatus such as an air conditioning unit or a furnace for maintaining comfort for the occupants of enclosures. More specifically, the invention is directed to controlling operation of a climate control system for maintaining within desired limits the temperature and humidity in an enclosure. The discussion and disclosure following will be based primarily on the air conditioning case. However, one of ordinary skill in the art could easily adapt the invention for other systems. The invention will typically be implemented in an electronic thermostat which uses a microcontroller in conjunction with a temperature sensor for controlling opening and closing of a solid state switch which controls the flow of operating current to the air conditioning control module.

Thermostats typically in use now which direct operation of air conditioners use dry-bulb temperature as the controlled variable. The term "dry-bulb temperature" is defined as the actual temperature of the air as measured by a typical thermometer. The use of the term "temperature" or "air temperature" hereafter will refer to dry-bulb temperature unless the context clearly directs otherwise. It is easy to measure air temperature and this measurement is already available in most thermostats. A typical thermostat in air conditioning mode causes the air conditioning to begin operating when temperature rises above a set point value. The air conditioner responds by injecting cold air into the enclosure until the temperature within the enclosure has fallen to a point below the set point value. The typical thermostat uses an anticipation element so as to turn off the air conditioning before the actual set point is reached. For many situations this type of control results in air which is comfortable for the enclosure's occupants.

It is well known that an air conditioner removes humidity from the air as well as cools it. The mechanism by which humidity is removed involves passing air from the enclosure or from the outside through the air conditioner, reducing the temperature of this air to substantially less than the comfort range of 70°–74° F. In order to remove humidity from the air, the temperature of at least some of it must be lowered to less than the current dew point temperature, the temperature at which water condenses from the air. Some of the water in the conditioned air condenses on the cooling coils of the air conditioner in this process and drips off the coils to a pan below, from which it drains. Because air will not release any of its humidity until it has reached 100% relative humidity, i.e., its dew point temperature for condensation to occur, it is necessary for at least the air adjacent the cooled surfaces of the heat exchanger to reach this temperature. In normal operation the total air stream through the air conditioner may not reach 100% relative humidity because not all of the air is cooled to its dew point. The relatively cold and dry conditioned air (relatively dry even though it has nearly 100% relative humidity) is mixed with the uncomfortably warm and humid air within the enclosure to achieve a more acceptable 40–60% relative humidity at a comfortable temperature of 70°–75° F.

Normally this procedure results in air within the enclosure whose humidity is within the comfort range. However, there are situations that can result in air having humidity which is still too high when the temperature requirement has been met. To achieve air at comfortable levels of both temperature and humidity, an air conditioner is sized for the expected load which the enclosure will present so that when the set point temperature is reached, humidity is acceptable. But in cases of unusually high humidity or where the air conditioner capacity relative to the current environmental conditions does not result in sufficient dehumidification when the set point temperature is reached, it is possible for the air in the enclosure to have excessive humidity.

It seems to be a simple solution to control the relative humidity in the enclosure by simply adding a relative humidity sensor to the thermostat, and then controlling the air conditioner to hold relative humidity within a selected set point range. A problem with this approach is that the relative humidity of the enclosure air may actually rise as the air is cooled and dehumidified within the enclosure. This possibility arises because the relative humidity is a function of both the amount of water vapor in a given volume or mass of air and its dry-bulb temperature. Relative humidity for any volume of air is defined as the ratio of the partial pressure of the water vapor in the air to the vapor pressure of saturated steam at that temperature. Since the vapor pressure of saturated steam drops rapidly with temperature, a relatively small amount of water vapor in a volume of air at a lower temperature can result in 100% relative humidity. It is thus possible to have a runaway situation where the humidity control function in the thermostat continues to call for further dehumidification, and as the temperature within the enclosure falls, relative humidity rises and locks the air conditioning on.

U.S. Pat. No. 3,651,864 (Maddox) teaches an air conditioning system which controls the relative humidity of enclosure air independently of the dry-bulb temperature. Maddox provides a humidistat responsive to relative humidity which operates in parallel with the normal dry-bulb temperature control. Because of the parallel operation of the two control functions, undesirable short cycles are possible. Furthermore, as previously mentioned, the relative humidity of the enclosure air may actually rise as the air is cooled and dehumidified within the enclosure. It is thus possible to have a runaway situation where the relative humidity control function as provided by the humidistat continues to call for further dehumidification, and as the temperature within the enclosure falls, relative humidity rises and locks the air conditioning on. These problems are solved by the present invention.

U.S. Pat. No. 5,345,776 (Komazaki et. al.) teaches a dehumidifying air conditioning system which utilizes two refrigerant heat exchangers supplied from the same compressor used sequentially on the conditioned air as a cooler/dehumidifier and reheater to control both relative humidity and dry-bulb temperature of enclosure air. A fuzzy logic controller is used to vary the compressor speed and the speed of the outdoor fan as a function of the measured relative humidity and dry-bulb temperature. As previously mentioned, the relative humidity of the enclosure air will actually rise as the air is cooled and dehumidified within the enclosure. It is thus possible to have a runaway situation where as the temperature within the enclosure falls, relative humidity rises and locks the air conditioning on. It is likely that in order to circumvent the mentioned runaway situation, it would be necessary to operate both indoor coils, viz., cooler/dehumidifier and reheater, simultaneously. The method described in U.S. Pat. No. 5,345,776 is more complicated by design when compared to commercially available conventional air conditioning units, including heat pump system, and requires more sophisticated controls and expensive hardware just for system operation. These problems are solved by the present invention which does not require any modifications to commercially available conventional air conditioning units, including heat pump system, and therefore can be easily and readily used in new and retrofit applications. Furthermore, the controls provided by the present invention is much simpler and will be substantially more robust in nature.

U.S. Pat. No. 4,105,063 (Bergt) is related art which discloses an air conditioning system which controls the dew-point temperature of enclosure air independently of the dry-bulb temperature. Bergt provides a sensor responsive to absolute moisture content which operates in parallel with the normal dry-bulb temperature control. Because of the parallel operation of the two control functions, undesirable short cycles are possible. This over-cycling problem is solved by the present invention.

U.S. Pat. No. 4,889,280 (Grald and MacArthur) is related art disclosing an auctioneering controller wherein the predetermined dry-bulb temperature set point is modified in response to a absolute humidity error signal. The enclosure temperature which results may not always be comfortable, and there is also a potential for overcycling.

U.S. Pat. No. 5,346,129 issued to this inventor and hereby incorporated by reference discloses a controller for a climate control system which has a relative humidity sensor as well as a dry-bulb temperature sensor within the enclosure. The relative humidity and dry-bulb temperature are used to determine a humidity (dew-point or wet-bulb) temperature. The humidity temperature value is used in conjunction with the dry-bulb temperature to generate a single error signal which is a function of both the dry-bulb and the humidity temperature values. This permits control of both enclosure temperature and enclosure humidity without abnormal cycling of the climate control system. The system as disclosed in U.S. Pat. No. 5,346,129 bases the error value on a function of the humidity temperature error and the dry-bulb temperature error. Experience has demonstrated that under certain circumstances the dry-bulb temperature within the enclosure can get reduced to a value significantly below the desired dry-bulb temperature set point as specified by the occupant in the enclosure. The inventor has further improved upon the '129 patent in U.S. patent application Ser. No. 08/664,012 now U.S. Pat. No. 5,737,934 filed Jun. 12, 1996 entitled, "Thermal Comfort Control" and in U.S. patent application Ser. No. 08/609,407 now U.S. Pat. No. 5,675,979 filed Mar. 1, 1999 entitled, "Enthalpy Based Thermal Comfort Controller". Both applications are currently copending, co-owned and hereby incorporated by reference. The present invention is an improvement upon these earlier invention by providing a reheat function only under certain operating conditions to overcome the reduced dry-bulb temperature.

BRIEF DESCRIPTION OF THE INVENTION

These and other shortcomings of the referenced, patents are solved by the present invention which computes an error value as a function of both the dry-bulb temperature and the dew point or wet-bulb temperature. This error value is then used as the input to a temperature control algorithm used by a controller for a climate control system to determine the times during which to activate the climate control system for modifying the temperature and humidity of air within an enclosure.

Such a controller includes a humidity sensor providing a humidity temperature signal encoding at least one wet-bulb temperature or the dew point temperature and a temperature sensor providing an air temperature signal encoding the dry-bulb temperature value. A memory records a dry-bulb temperature set point value and a humidity temperature set point value, and provides a set point signal encoding the dry-bulb and humidity temperatures set point values. A comparison means receives the humidity and air temperature signals and the set point signals, and computes an error value as a function of the values encoded in the humidity and air temperature signals and the set point signals, and issues demand signals responsive to a predetermined range of error values. In a typical arrangement, the demand signals are supplied to the climate control system. While the demand signals are present, the climate control system operates to reduce the error value by cooling and possibly also heating the enclosure air and decreasing or increasing its humidity so as to shift the enclosure's humidity and dry-bulb temperatures closer to their respective set point values.

DESCRIPTION OF THE PREFERRED EMBODIMENTS

Figure 1:
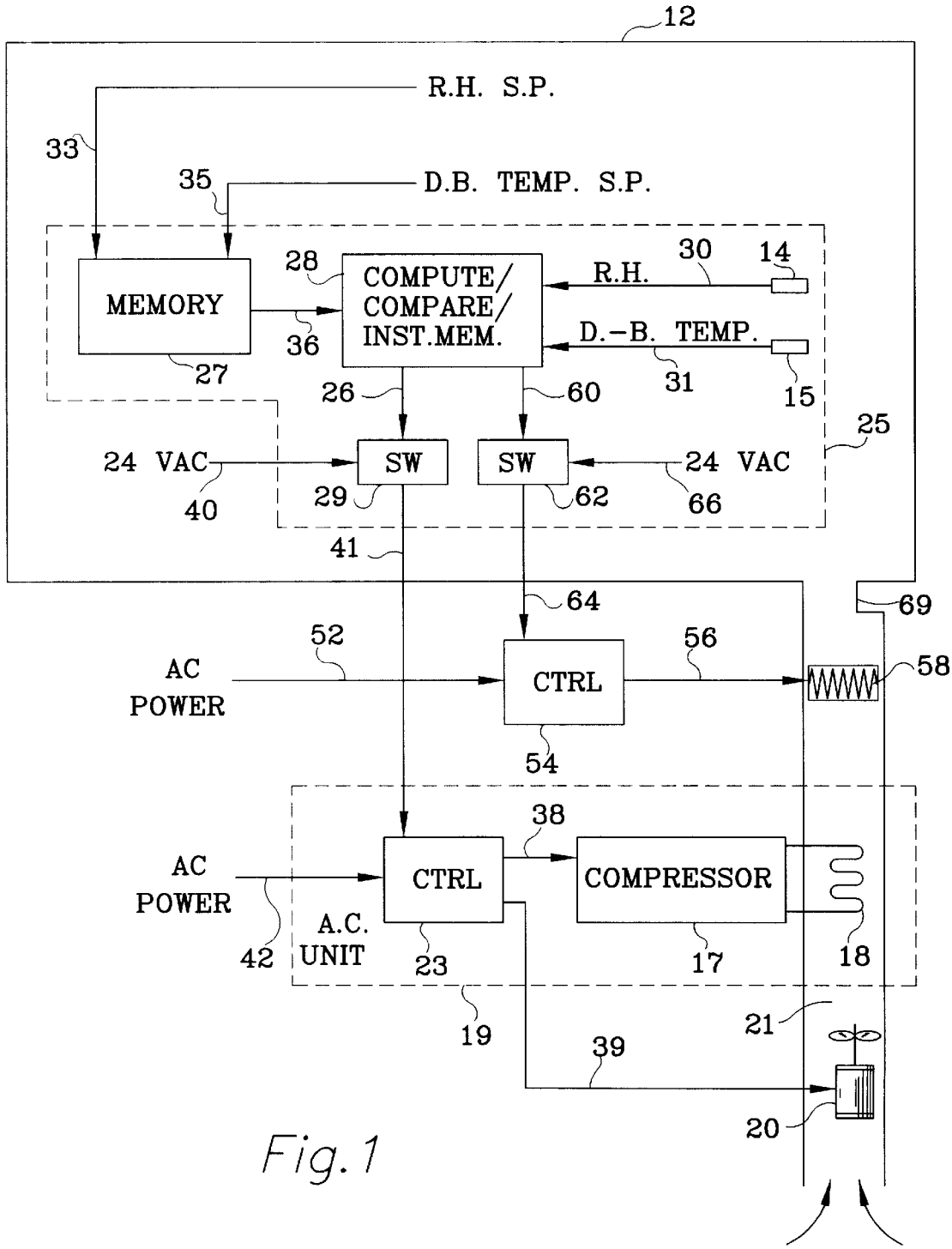
FIG. 1 is a block diagram of complete air conditioning installation employing the invention.

FIG. 1 illustrates the invention implemented in a Controller 25 for an air conditioning installation. Enclosure 12 receives cooled and dehumidified air from a conventional air conditioning unit 19 through ductwork 69. Air conditioning unit 19 operates on externally supplied AC power provided on conductors 42. Reheat unit 58 also operates on externally supplied AC power provided on conductors 52. Reheat unit 58 is located in plenum 21 and operates to reheat the cooled air passing through plenum 21 to duct 69. A control element 54 switches power to electrical resistive heating elements 58 on conductor 56 thereby providing sequencing as needed for its operation. Reheat unit 58 is illustrated as an electrical heater in the preferred embodiment however other heating elements including but not limited to steam, hot water, or natural gas could also be utilized. The reheat unit 58 operates when a demand signal is present on path 60. The demand signal on path 60 closes switch 62, allowing control current supplied by a 24 VAC source on path 66 to flow to the reheat unit controller 54 on path 64. Control element 23 switches power to compressor 17 and blower 20 on conductors 38 and 39 respectively, thereby providing sequencing as needed for their operation. Compressor 17 provides liquid coolant to evaporator coil 18 which is located in plenum 21 along with blower 20 and reheat unit 58. Air conditioning unit 19 operates while a demand signal is present on path 26. The demand signal on path 26 closes switch 29, allowing control current supplied by a 24 VAC source on path 40 to flow to the air conditioning unit controller 23 on path 41. While air conditioning unit 19 is operating, fan 20 first forces air across coil 18 to cool and dehumidify the air and then across reheat unit 58 to add heat to the air if and as needed as directed by the presence or absence of a demand signal on path 60. This conditioned air flows into enclosure 12 through duct 69 to reduce both the temperature and humidity of the air within enclosure 12. The demand signals on paths 26 and 60 are provided by a controller 25 whose functions occur within electronic circuitry. Controller 25 will typically be attached to a wall of enclosure 12 in the manner done for conventional thermostats.

Controller 25 includes memory unit 27 which can store digital data and processor unit 28 which can perform computation and comparison operations on data supplied to it from both memory 27 and from external sources. Processor unit 28 also includes an instruction memory element. In the preferred embodiment a conventional microcontroller is used to function as memory 27 and processor 28. Controller 25 further comprises humidity sensor 14 located within enclosure 12 which provides a humidity signal on path 30 encoding the relative humidity of the air within enclosure 12, but alternatively may encode the dew point temperature or the wet-bulb temperature of this air. Temperature sensor 15 also located within enclosure 12 similarly encodes a dry-bulb temperature value in an air temperature signal on path 31. Processor 28 receives these temperature signals and converts them to digital values for internal operations.

Paths 33 and 35 carry signals to memory 27 encoding various set point values necessary for implementing this invention. Typically the signals on paths 33 and 35 are provided by the person responsible for controlling the climate of enclosure 12. If this person is an occupant of enclosure 12, the set point values may be selected by simply shifting control levers or dials carried on the exterior of controller 25. The values may also be selected by a keypad which provides digital values for the set points in the signals on paths 33 and 35. Path 33 carries a humidity signal encoding a humidity set point value representative of the desired relative humidity within the enclosure 12. This humidity set point value may be actual desired relative humidity, or the desired dew point temperature, or even the desired wet-bulb temperature. Path 35 carries a signal encoding an air (dry-bulb) temperature set point value. Memory 27 records these two set point values, and encodes them in set point signals carried to processor 28 on a path 36. If memory 27 and processor 28 are formed of a conventional microcontroller, the procedures by which these set point values are provided to processor 28 when needed are included in further circuitry not shown which provides a conventional control function for the overall operation of such a microcontroller.

Figure 2:
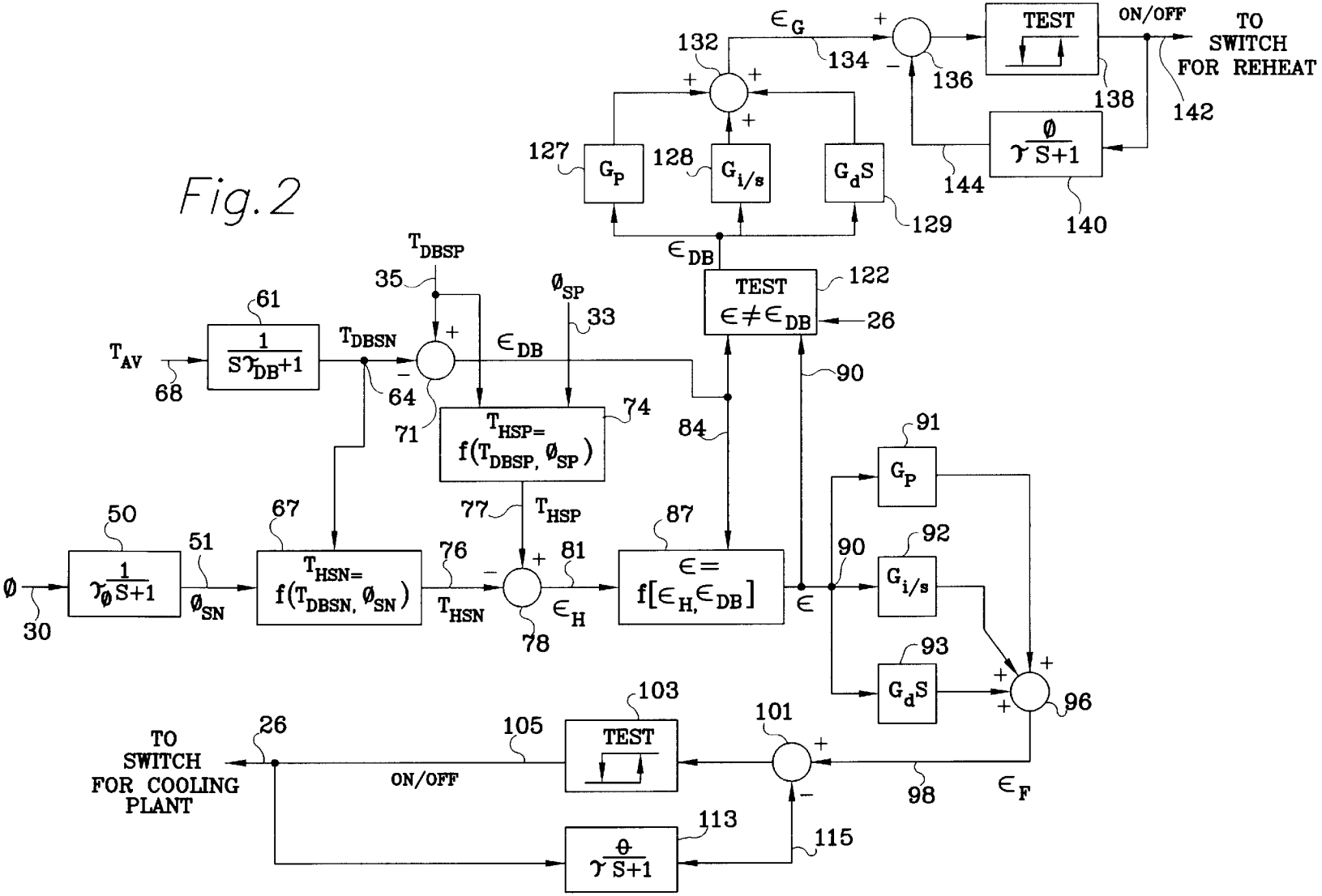
FIG. 2 is a computation diagram specifying a preferred embodiment of the algorithm implemented by a controller for a climate control system.

Processor unit 28 has internal to it, a read-only memory (ROM) in which are prestored a sequence of instructions which are executed by processor unit 28. The execution of these instructions results in processor unit 28 performing the functions shown in detail by the functional block diagram of FIG. 2. FIG. 2 is much more useful to the reader than is FIG. 1 in understanding both the invention itself as well as the preferred embodiment. The reader should understand that FIG. 2 represents and explains modifications to the hardware broadly shown in FIG. 1, which modifications allow processor unit 28 to implement our invention. We wish to emphasize that each element of FIG. 2 has an actual physical embodiment within processor unit 28. This physical embodiment arises from the actual physical presence of structure within processor unit 28 which provide the functions of the various elements and data paths shown in FIG. 2. The execution of each instruction causes the processor unit 28 to physically become part of an element shown in FIG. 2 while the instruction is executed. The ROM within processor unit 28 also forms a part of each of the functional blocks in FIG. 2 by virtue of it storing and supplying the instructions which cause the creation of the functional blocks. There are also arithmetic operation registers within processor unit 28 which temporarily store the results of computations. These can be considered to form a part of memory 27 even though perhaps physically located within the processor unit portion of the microcontroller.

Signal transmissions are represented in FIG. 2 by lines originating from one functional block and terminating at another as shown by the arrow. This implies that signals created by one function element are supplied to another for use. Within a microcontroller, this occurs when a series of instructions whose execution causes the microcontroller to comprise one functional element, actually produces digital values which are then transmitted within the microcontroller on its signal paths for use by the circuitry when executing instructions for another functional element. It is entirely possible that the same physical signal paths within a microcontroller will carry many different signals each whose paths are shown individually in FIG. 2. In fact, one can think of a single such physical path as being time shared by the various functional blocks. That is, such an internal path of a microcontroller may at different times, perhaps only microseconds apart, serve as any one of the various paths shown in FIG. 2

At this point, it is helpful to supply a legend which tabularly defines each value encoded in the signals shown in FIG. 2:

$T_{AV}$—Weighted average temperature of enclosure 12

$\phi$—Relative humidity of Enclosure 12

$T_{DBSN}$—Sensor-derived dry-bulb temperature of the air in enclosure 12 with lag corrections $T_{DBSP}$—Dry-bulb temperature set point for enclosure 12

$\phi_{SP}$—Relative humidity set point for enclosure 12

$\phi_{SN}$—Sensor-derived relative humidity in enclosure 12 with lag corrections $\epsilon_{DB}$—Dry-bulb temperature error $T_{HSN}$—Sensed humidity temperature in enclosure 12

$T_{HSP}$—Calculated humidity temperature set point for enclosure 12

$\epsilon_H$—Humidity temperature error $\epsilon_F$—Final error value provided by P-I-D function for the air conditioning unit $\epsilon_G$—Final error value provided by P-I-D function for the reheat unit In FIG. 2, the individual functional blocks have internal labels which describe the individual functions which each represent. Established conventions are followed in FIG. 2 to represent the various functions which comprise the invention. Each rectangular block, say block 61, represents some type of mathematical or computational operation on the value encoded in the signal supplied to the block. Thus, the signal on path 68, which encodes the average room temperature $T_{AV}$, is shown supplied to functional block 61, to collectively represent apparatus which forms a Laplace operator transform $T_{AV}$. Other functional blocks represent decision operations, calculation of other mathematical functions, such as multiplication, and other Laplace transform operations of various types. Circles to which are supplied two or more signals imply a sum or difference calculation as indicated by the adjacent plus or minus sign. Thus the plus and minus signs adjacent the junctions of paths 35 and 64 with summation element 71 implies subtraction of the value encoded in the signal on paths 64 from the value encoded on path 35.

The various calculations, operations, and decisions represented by FIG. 2 are performed in the sequence indicated at regular intervals, typically either each minute or continuously. If calculations proceed continuously, then it is necessary to determine the time which elapses from one completion to the next in order to determine the rates of change of various values where this is important to the operation. Since temperatures and humidities within an enclosure 12 usually change very slowly, a once per minute calculation usually provides more than adequate accuracy of control.

Block 61 receives a signal on path 68 encoding a value $T_{AV}$ which represents a weighted average of the wall temperature and the air temperature in enclosure 12. Block 61 represents a Laplace transform operation on $T_{AV}$ intended to compensate for sensor response lag, and produces a signal on path 64 encoding $T_{DBSN}$. The computation of $T_{DBSN}$ is conventional. The $T_{DBSN}$ value on path 64 is subtracted from $T_{DBSP}$ encoded in the signal on path 35 to produce the dry-bulb temperature error value $\epsilon_{DB}$. $\epsilon_{DB}$ is encoded in the signal on path 84.

One of the advances which this invention provides is the use of humidity as a further variable for computing the error used for controlling operation of the air conditioning unit 19 shown in FIG. 1. To accomplish this, our preferred apparatus uses a relative humidity value $\phi$ encoded in a signal from sensor 14 supplied on path 30. The $\phi$ value is supplied to a Laplace transform operation block 50 which compensates for the lag and instability in sensor 14, and provides a transformed relative humidity value $\phi_{SN}$ on path 5 1.

It is well known to determine both wet-bulb and dew point temperatures (either of which are hereafter collectively referred to as a humidity temperature) from a given dry-bulb temperature and a given relative humidity value. This is simply the digital or computational equivalent of manually looking up a value in a standard psychrometric chart. Computation block 67 receives $\phi_{SN}$ and $T_{DBSN}$ and computes from these values an approximation of one of the humidity temperatures $T_{HSN}$, and encodes this value in the signal on path 76. One can consider block 67 as forming a part of the humidity sensor 14 which together comprise a composite sensor providing a humidity temperature value $T_{HSN}$.

Computation block 74 performs a similar computation to derive an approximation for the humidity temperature set point $T_{HSP}$ from the dry-bulb temperature set point and the relative humidity set point. In fact, it is likely that the same instructions within the processor 26 memory will serve to make both computations at different times, these instructions forming a subroutine which is called at the appropriate time and supplied with the relevant relative humidity value and dry-bulb temperature. Block 74 receives the $T_{DBSP}$ value on path 35 and the $\phi_{SP}$ value on path 33 and encodes the corresponding set point humidity temperature $T_{HSP}$ value in a signal on path 77. Block 74 can be considered as including a memory element which briefly stores $T_{HSP}$ at the end of the calculation. Summing block 78 receives the $T_{HSP}$ and $T_{HSN}$ values on paths 77 and 76 respectively, and forms the error value $\epsilon_H = T_{HSP} - T_{HSN}$ which is encoded in a signal carried on path 81. The individual signals on paths 81 and 84 encoding $\epsilon_H$ and $\epsilon_{DB}$ can be considered as collectively forming a first or initial error signal.

Figure 3:
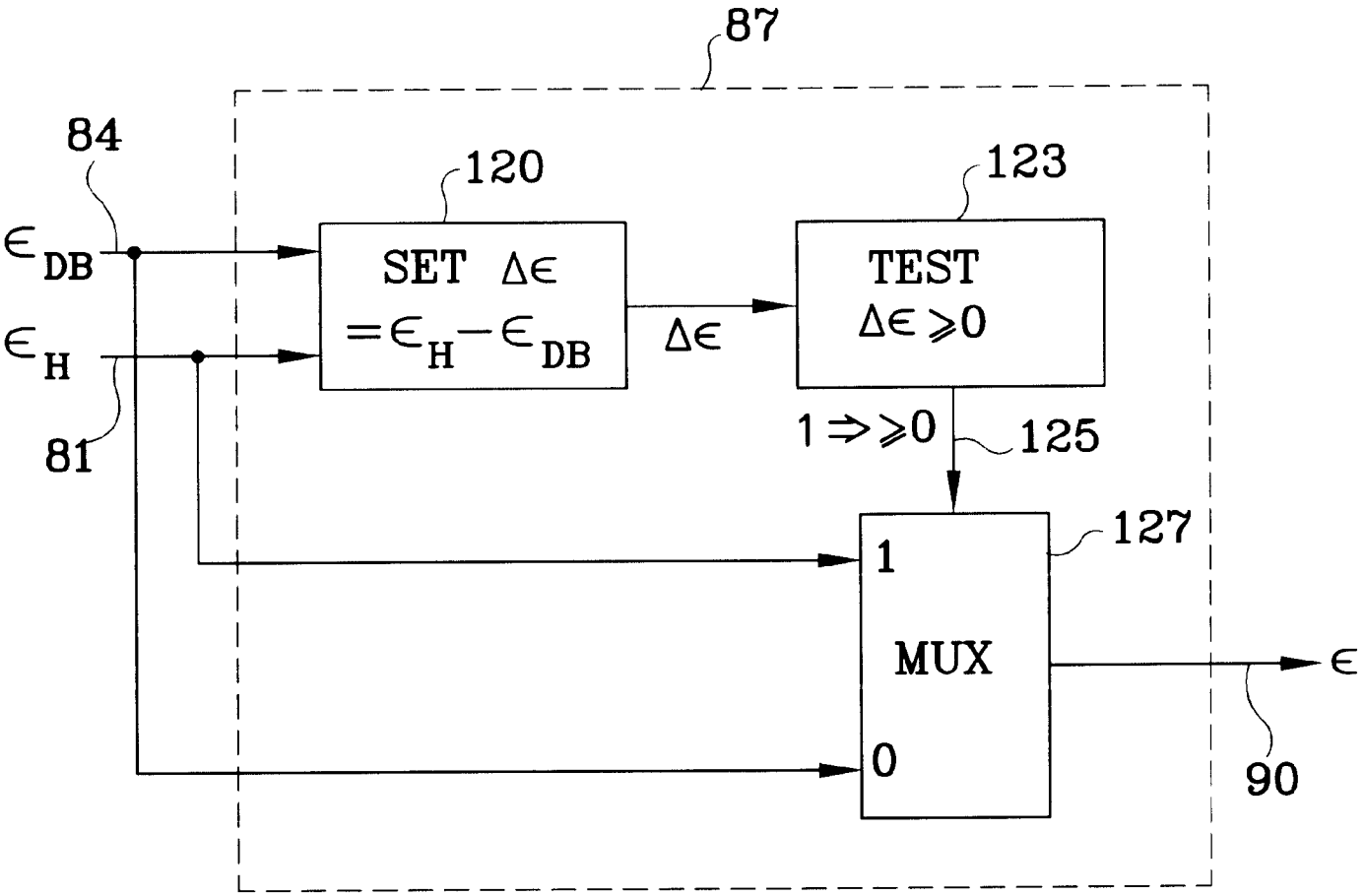
FIG. 3 is a diagram which discloses a preferred embodiment of the element which form a composite error value.

Computation block 87 uses the dry bulb temperature error $\epsilon_{DB}$ and the humidity temperature error $\epsilon_H$ to derive a second level or composite error value $\epsilon$ which is encoded in the signal carried on path 90. (The term "computation" is used here in a broad sense to include any sort of data manipulation.) There are a number of different algorithms by which the composite error value can be derived. The algorithm which we currently prefer is to simply set $\epsilon$ to the larger of $\epsilon_{DB}$ and $\epsilon_H$ and this is what is implied by the dual stroke brackets shown in the function which labels computation block 87. FIG. 3, which shows one implementation of apparatus for selecting the larger of $\epsilon_H$ and $\epsilon_{DB}$, is explained below. The composite error value $\epsilon$, further may characterize the apparent temperature error value or the enthalpy error value. Both apparent temperature and enthalpy are well known in the art and are easily calculatable from the relative humidity and dry-bulb temperature.

It is not preferred to use the composite error value $\epsilon$ directly for deriving a demand signal for the air conditioning unit 19. Instead $\epsilon$ is provided to a conventional. PID (proportional, integral, derivative) control function comprising the $G_P$, $G_i/s$ and $G_d s$ blocks 91–93 whose output values are then summed by a summing block 96 (also a part of the PID control function) to produce a final error value $\epsilon_F$ encoded in a final error signal on path 98.

The final error value $\epsilon_F$ carried on path 98 is converted to the air conditioning unit 19 demand signal on path 26. $\epsilon_F$ is preferably modified through a number of computational stages according to known practice to insert an anticipation function in deriving the final air conditioning unit 19 demand signal on path 26. Each stage of the air conditioning unit 19 demand signal computation produces a signal having a logical 1 voltage level, which can be thought of as corresponding to the ON condition of air conditioning unit 19. The signal voltage on path 26 has a level corresponding to a logical 0 when the demand signal for the air conditioning unit 19 is not present. When a logical 1 is present on path 26, then switch 29 (see FIG. 1) is closed and current flows to controller 23 of air conditioning unit 19. When path 26 carries a logical 0 value, switch 29 is open and unit 19 does not operate.

The anticipation function is implemented in a conventional manner by the summing block 101 and functional blocks 103 and 113. Block 113 applies a Laplace transform operation $\theta/(\tau s+1)$ in a known manner to the signal carried on path 26, shifting its logical 0 and 1 values in time. Hysteresis test block 103 provides a first stage demand signal on path 26. If the Laplace transform block 113 returns a value of 0 on path 115 to summing block 101, then the final error value $\epsilon_F$ on path 98 is used by the hysteresis test block 103 to determine the times and lengths of the first stage of the air conditioning unit 19 demand signal on path 26. If block 113 returns a value different from zero to summing block 101 then the error value $\epsilon_F$ on path 98 supplied to test block 103 is reduced by summation block 101, which will delay the starts of the demand signal and shorten its interval length, thereby delaying startup and speeding up shutdown times of air conditioning unit 19.

Although the description of how the air conditioner signal is determined is calculated utilizing the invention that is disclosed in U.S. Pat. No. 5,346,129, other schemes for calculating the error signal are possible including those enclosed in U.S. Pat. Nos. 5,737,934 and 5,675,979 as viable alternatives. These patents are co-owned and invented by applicant and are hereby incorporated by reference.

An improvement over U.S. Pat. No. 5,346,129 provided by this invention is the ability to reheat the cooled and dehumidified air prior to introducing it into the enclosure 12 so as to create a comfortable environment for the occupants of enclosure 12. In certain rare situations of extremely high humidity or poorly sized air conditioning units, or where a relatively low value for $\phi_{SP}$ is selected, it is possible that an uncomfortably low value of sensed dry-bulb temperature $T_{DBSN}$ may result when the humidity error $\epsilon_H$ has been increased to a level producing an $\epsilon$ value on path 90 allowing the air conditioning unit 19 to be on (i.e., run). To deal with this problem test block 122 receives the air conditioning unit 19 demand signal on path 26 and the dry-bulb temperature error $\epsilon_{DB}$ on path 84 and also the composite error $\epsilon$ on path 90. If the air conditioning unit 19 demand signal is not present on path 26, i.e., if the air conditioning unit 19 is off, then the demand signal on path 142 for the reheat unit 58 (see FIG. 1) is also not present, i.e., the demand signal on path 142 is set to zero such that the reheat unit 58 is also off If the air conditioning unit 19 demand signal is present on path 26, additional logic is required to determine the on or off status of reheat unit 58. If the demand signal on path 26 for the air conditioning unit 19 is present and if the condition $\epsilon \neq \epsilon_{DB}$ arises, then it implies that $\epsilon = \epsilon_H$ and that the operation of air conditioning unit 19 is being dictated by the humidity error $\epsilon_H$ and that further operation of air conditioning unit 19 could result in an uncomfortably low value of the dry-bulb temperature within enclosure 19. Under this circumstance the dry-bulb temperature error $\epsilon_{DB}$ is provided to a conventional PID (proportional, integral, derivative) control function comprising the $G_p$, $G_i/s$ and $G_d s$ blocks 127–129 whose output values are then summed by a summing block 132 (also a part of the PID control function) to produce a final error value $\epsilon_G$ encoded in a final error signal on path 134 for reheat unit 58.

The final error value $\epsilon_G$ carried on path 134 for reheat unit 58 is converted to the reheat unit 58 demand signal on path 142. $\epsilon_G$ is preferably modified through a number of computational stages according to known practice to insert an anticipation function in deriving the final reheat unit 58 demand signal on path 142. Each stage of the reheat unit 58 demand signal computation produces a signal having a logical 1 voltage level, which can be thought of as corresponding to the ON condition of reheat unit 58. The signal voltage on path 142 has a level corresponding to a logical 0 when the demand signal for the reheat unit 58 is not present. When a logical 1 is present on path 142, then switch 62 (see FIG. 1) is closed and current flows to controller 54 of reheat unit 58. When path 142 carries a logical 0 value, switch 62 is open and unit 58 does not operate.

The anticipation function is implemented in a conventional manner by the summing block 136 and functional blocks 138 and 140. Block 140 applies a Laplace transform operation $\theta/(\tau s+1)$ in a known manner to the signal carried on path 142, shifting its logical 0 and 1 values in time. Hysteresis test block 138 provides a first stage demand signal on path 142. If the Laplace transform block 140 returns a value of 0 on path 144 to summing block 136, then the final error value $\epsilon_G$ on path 134 is used by the hysteresis test block 138 to determine the times and lengths of the first stage of the reheat unit 58 demand signal on path 142. If block 140 returns a value different from zero to summing block 136 then the error value $\epsilon_G$ on path 134 supplied to test block 138 is reduced by summation block 136, which will delay the starts of the demand signal and shorten its interval length, thereby delaying startup and speeding up shutdown times of reheat unit 58.

FIG. 3 shows one implementation for the preferred algorithm for deriving the composite error value. In FIG. 3, a difference element 120 receives $\epsilon_H$ and $\epsilon_{DB}$ on paths 81 and 84, and forms an error difference value $\Delta\epsilon = \epsilon_H - \epsilon_{DB}$. $\Delta\epsilon$ is encoded in a signal carried to a test element 123 which compares $\Delta\epsilon$ to 0. If $\Delta\epsilon \geqq 0$ is true, a select signal carried on path 125 encodes a binary 1. The "$\geqq$" symbol means "implies" or "connotes", thus a binary 1 in the signal on path 125 means that the condition $\Delta\epsilon \geqq 0$ has been sensed. A multiplexer 127 receives on path 125 the select signal, whose value when a binary 1 enables port 1 to gate the value $\epsilon_H$ on path 81 to the output path 90 as $\epsilon$, and when a binary 0 enables port 0, gating $\epsilon_{DB}$ on path 84 to path 90. This is only one of a number of suitable ways by which the relative magnitudes of $\epsilon_H$ and $\epsilon_{DB}$ can be used to gate the larger of the two to path 90. In a microcontroller implementation, the software reproduces the functions shown in FIG. 3 in one manner or another.

We claim:

1. An Apparatus for cooperating with a controller for a climate control system for modifying the temperature and humidity of air within an enclosure, said climate control system comprising air conditioning means and reheat means, said controller activating the air conditioning means of the climate control system responsive to a composite error value encoded in a composite error signal, said controller activating said reheat means of the climate control system responsive to an air temperature error signal encoding an air temperature error value, said apparatus comprising:

a humidity sensor providing a humidity signal encoding a humidity value;

a temperature sensor providing an air temperature signal encoding an air temperature value;

means for receiving the humidity signal and the air temperature signal for computing a humidity temperature value;

a memory for recording an air temperature setpoint value and a humidity setpoint value;

means for calculating a humidity temperature setpoint value as a function of the air temperature setpoint value and humidity setpoint value a first computation means for computing the composite error value as a function of the humidity temperature setpoint value, the humidity temperature value, the air temperature setpoint value and the air temperature value; and a second computation means for computing the air temperature error value as a function of the air temperature setpoint value and the air temperature value.

2. The apparatus of claim 1 further comprising an error processing means receiving the composite error signal for providing a demand signal during intervals determined as a function of the composite error value.

3. The apparatus of claim 1 further comprising an air temperature error processing means receiving the air temperature error signal for providing a reheat demand signal during intervals determined as a function of the air temperature error value.

4. The apparatus of claim 2 further comprising an air temperature error processing means receiving the air temperature error signal for providing a reheat demand signal during intervals determined as a function of the air temperature error value.

5. The apparatus of claim 1, wherein the humidity sensor comprises a) a relative humidity sensor providing a relative humidity signal encoding the value of an ambient relative humidity; and b) humidity temperature computation means receiving the air temperature signal and the relative humidity signal, for computing a humidity temperature approximation value, and for encoding the humidity temperature approximation value in the humidity temperature signal.

6. The apparatus of claim 5, wherein the memory further comprises means for recording a relative humidity set point value, and means receiving the relative humidity set point value and the dry-bulb temperature set point value, for computing the humidity temperature set point value as a function of the relative humidity set point value and the dry-bulb temperature set point value, and for providing a signal encoding the computed humidity temperature set point value, and wherein the memory includes means receiving the computed humidity temperature set point value signal, for recording the computed humidity temperature set point value.

7. The apparatus of claim 1, wherein the memory further comprises i) means for recording a relative humidity set point value, and ii) computed set point recording means for recording a computed humidity temperature set point value encoded in a computed humidity temperature set point value signal, and iii) means for encoding the computed humidity temperature set point value as the humidity temperature set point value in the set point signal; and wherein the controller further comprises computing means receiving the relative humidity set point value and the dry-bulb temperature set point value, for computing the humidity temperature set point value as a function of the relative humidity set point value and the dry-bulb temperature set point value.

8. The apparatus of claim 7, wherein the first computation means further comprises:

i) computing means for forming a humidity temperature error equal to the difference between the humidity temperature value and the humidity temperature set point value, for forming a dry-bulb temperature error equal to the difference between the dry-bulb temperature value and the dry-bulb temperature set point value, and for providing an initial error signal encoding the humidity temperature error and the dry-bulb temperature error; and ii) comparison means receiving the initial error signal, for sensing the relative magnitudes of the humidity temperature error and the dry-bulb temperature error and for encoding in the composite error signal, the larger of the errors encoded in the initial error signal.

9. The apparatus of claim 1, wherein the first computation means further comprises i) computing means for forming a humidity temperature error equal to the difference between the humidity temperature value and the humidity temperature set point value, for forming a dry-bulb temperature error equal to the difference between the dry-bulb temperature value and the dry-bulb temperature set point value, and for providing an initial error signal encoding the humidity temperature error and the dry-bulb temperature error; and ii) comparison means receiving the initial error signal, for sensing the relative magnitudes of the humidity temperature error and the dry-bulb temperature error and for encoding in the composite error signal, the larger of the errors encoded in the initial error signal.

10. The apparatus of claim 1 further comprising a variable capacity cooling means.

11. The apparatus of claim 1 further comprising a multi-stage cooling means.

12. The apparatus of claim 1 further comprising a fan coil cooling means.

13. The apparatus of claim 1 further comprising a heat pump.

14. The apparatus of claim 1 wherein the humidity temperature value is wet-bulb temperature.

15. The apparatus of claim 1 wherein the humidity temperature value is apparent temperature.

16. The apparatus of claim 1 further comprising an air temperature error processing means receiving the air temperature error signal for providing a reheat demand signal during intervals determined as a function of the air temperature error value.

17. Apparatus for cooperating with a controller for a climate control system for modifying the temperature and moisture content of air within an enclosure, said climate control system comprising air conditioning means and reheat means, said controller activating the air conditioning means of the climate control system responsive to an apparent temperature error value encoded in an apparent temperature error signal, said controller activating said reheat means of the climate control system responsive to an air temperature error signal encoding an air temperature error value, said apparatus comprising:

a) a relative humidity sensor providing a relative humidity signal encoding the relative humidity value;

b) a temperature sensor providing an air temperature signal encoding the dry-bulb temperature value;

c) a memory recording a set point signal encoding an apparent temperature set point value;

d) a second memory encoding an air temperature set point value;

e) error computation means receiving the humidity and air temperature signals and the set point signal, for computing the apparent temperature error value as a function of the values encoded in the humidity and air temperature signals and the set point signal, and for encoding the apparent temperature error value in the apparent temperature error signal; and f) a second error computation means for computing the air temperature error value as a function of the air temperature setpoint value and the air temperature value.

18. The apparatus of claim 17, wherein the error computation means further comprises computing means for forming an apparent temperature value based on the relative humidity value and the dry-bulb temperature value, and for computing the apparent temperature error value equal to the difference between the apparent temperature set point value and the apparent temperature value.

19. The apparatus of claim 18 further comprising an error processing means receiving the apparent temperature error signal for providing a demand signal during intervals determined as a function of the apparent temperature error value.

20. The apparatus of claim 17 further comprising a variable capacity cooling means.

21. The apparatus of claim 17 further comprising a multi-stage cooling means.

22. The apparatus of claim 17 further comprising a fan coil cooling means.

23. The apparatus of claim 17 further comprising a heat pump.

24. The apparatus of claim 1 wherein the humidity temperature value is dew-point temperature.

25. The apparatus of claim 17 wherein the humidity temperature value is dew-point temperature.

26. The apparatus of claim 17 wherein the humidity temperature value is wet-bulb temperature.

27. The apparatus of claim 17 wherein the humidity temperature value is apparent temperature.

28. The apparatus of claim 17 further comprising an air temperature error processing means receiving the air temperature error signal for providing a reheat demand signal during intervals determined as a function of the air temperature error value.

29. Apparatus for cooperating with a controller for a climate control system for modifying the temperature and moisture content of air within an enclosure, said climate control system comprising air conditioning means and reheat means, said controller activating the air conditioning means of the climate control system responsive to an enthalpy error value encoded in an enthalpy error signal, said controller activating said reheat means of the climate control system responsive to an air temperature error signal encoding an air temperature error value, said apparatus comprising:

a) a relative humidity sensor providing a relative humidity signal encoding the relative humidity value;

b) a temperature sensor providing an air temperature signal encoding the dry-bulb temperature value;

c) a memory recording a dry-bulb temperature set point value and a relative humidity set point value, and providing a set point signal encoding the dry-bulb temperature and relative humidity set point values;

d) error computation means receiving the humidity and air temperature signals and the set point signals, for computing the enthalpy error value as a function of the values encoded in the humidity and air temperature signals and the set point signals, and for encoding the enthalpy error value in the enthalpy error signal; and e) a second error computation means for computing the air temperature error value as a function of the dry-bulb temperature setpoint value and the air temperature value.

30. The apparatus of claim 29, wherein the error computation means further comprises computing means for forming an enthalpy set point value based on the set point signals, and for forming an enthalpy value based on the relative humidity value and the dry-bulb temperature value, and for computing the enthalpy error value equal to the difference between the enthalpy set point value and the enthalpy value.

31. The apparatus of claim 30 further comprising an error processing means receiving the enthalpy error signal for providing a demand signal during intervals determined as a function of the enthalpy error value.

32. The apparatus of claim 29 further comprising an air temperature error processing means receiving the air temperature error signal for providing a reheat demand signal during intervals determined as a function of the air temperature error value.

33. The apparatus of claim 29 further comprising a variable capacity cooling means.

34. The apparatus of claim 29 further comprising a multi-stage cooling means.

35. The apparatus of claim 29 further comprising a fan coil cooling means.

36. The apparatus of claim 29 further comprising a heat pump.

37. The apparatus of claim 29 wherein the humidity value is dew-point temperature.

38. The apparatus of claim 29 wherein the humidity value is wet-bulb temperature.

39. Apparatus for cooperating with a controller for a climate control system for modifying the temperature and moisture content of air within an enclosure, said climate control system comprising air conditioning means and reheat means, said controller activating the air conditioning means of the climate control system responsive to an apparent temperature error value encoded in an apparent temperature error signal, said controller activating said reheat means of the climate control system responsive to an air temperature error signal encoding an air temperature error value, said apparatus comprising:

a) a means for determining the space apparent temperature by sensing any two thermodynamic properties of the moist air within the enclosure and providing a sensed apparent temperature signal encoding the sensed apparent temperature value and further providing an air temperature value;

b) a memory recording an apparent temperature set point value and providing an apparent temperature set point signal encoding the apparent temperature set point value;

c) a second memory recording a dry-bulb temperature set point value and providing an air temperature setpoint signal encoding the dry bulb temperature setpoint value;

d) error computation means receiving the sensed apparent temperature signal and the apparent temperature set point signal, for computing the apparent temperature error value as a function of the values encoded in the sensed apparent temperature signal and the apparent temperature set point signal, and for encoding the apparent temperature error value in the apparent temperature error signal; and e) a second error computation means for computing the air temperature error value as a function of the dry bulb temperature setpoint value and the air temperature value.

40. The apparatus of claim 39, wherein the error computation means further comprises computing means for computing the apparent temperature error value equal to the difference between the apparent temperature set point value and the apparent temperature value.

41. The apparatus of claim 40 further comprising an error processing means receiving the apparent temperature error signal for providing a demand signal during intervals determined as a function of the apparent temperature error value.

42. The apparatus of claim 40 further comprising an air temperature error processing means receiving the air temperature error signal for providing a reheat demand signal during intervals determined as a function of the air temperature error value.

43. The apparatus of claim 40 further comprising a variable capacity cooling means.

44. The apparatus of claim 40 further comprising a multi-stage cooling means.

45. The apparatus of claim 40 further comprising a fan coil cooling means.

46. The apparatus of claim 40 further comprising a heat pump.

* * * * *